United States Patent [19]

Suzuki et al.

[11] Patent Number: 5,058,480

[45] Date of Patent: Oct. 22, 1991

[54] SWING ACTIVATED MUSICAL TONE CONTROL APPARATUS

[75] Inventors: Hideo Suzuki; Masao Sakama, both of Hamamatsu, Japan

[73] Assignee: Yamaha Corporation, Hamamatsu, Japan

[21] Appl. No.: 342,487

[22] Filed: Apr. 24, 1989

[30] Foreign Application Priority Data

Apr. 28, 1988 [JP] Japan ..... 63-106698

[51] Int. Cl.[5] ..... G10H 1/18; G10H 1/32; G10H 1/46

[52] U.S. Cl. ..... 84/600; 84/687; 84/692; 84/711

[58] Field of Search ..... 84/622–627, 84/633, 645, 658–663, 665, 687–690, 692–703, 711, 735–738, 741, 600, 615, 723–725, 730, 733, 734, 422.1, 422.2, 422.3, 422.4, DIG. 12, DIG. 24; 340/384 R, 384 E

[56] References Cited

U.S. PATENT DOCUMENTS 4,337,460 6/1982 Smith, III et al. ..... 340/384 E
4,343,140 7/1982 Ishida ..... 84/711
4,776,253 10/1988 Downes ..... 84/645
4,909,117 3/1990 Reiling et al. ..... 84/DIG. 12
4,995,294 2/1991 Kashio et al. ..... 84/735

FOREIGN PATENT DOCUMENTS 63-132295 6/1988 Japan .

*Primary Examiner*—Stanley J. Witkowski
*Attorney, Agent, or Firm*—Spensley, Horn, Jubas & Lubitz

[57] ABSTRACT

A musical-tone-control apparatus having a baton which is provided with an acceleration sensor, and which is swung by a performer is provided. The intensity of a swing of the baton is detected by the acceleration sensor, and controls the tone-generation timing and tone elements such as tone pitches, tone volumes, or tone colors. The intensity of a swing is detected after a predetermined interval has elapsed from the beginning of a swing. As a result, a delay of detection of the intensity due to the inertia of the swing is eliminated. Hence, the swings and the tone-generating timing of musical tones are in harmony, which allows the performer to enjoy a natural feeling of performance.

10 Claims, 4 Drawing Sheets

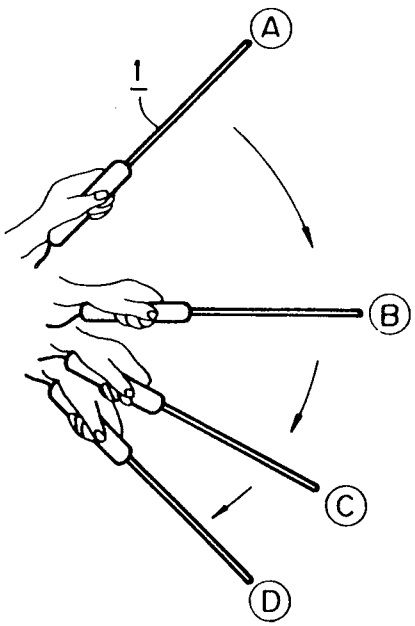
FIG. 3 (SWING DOWN)
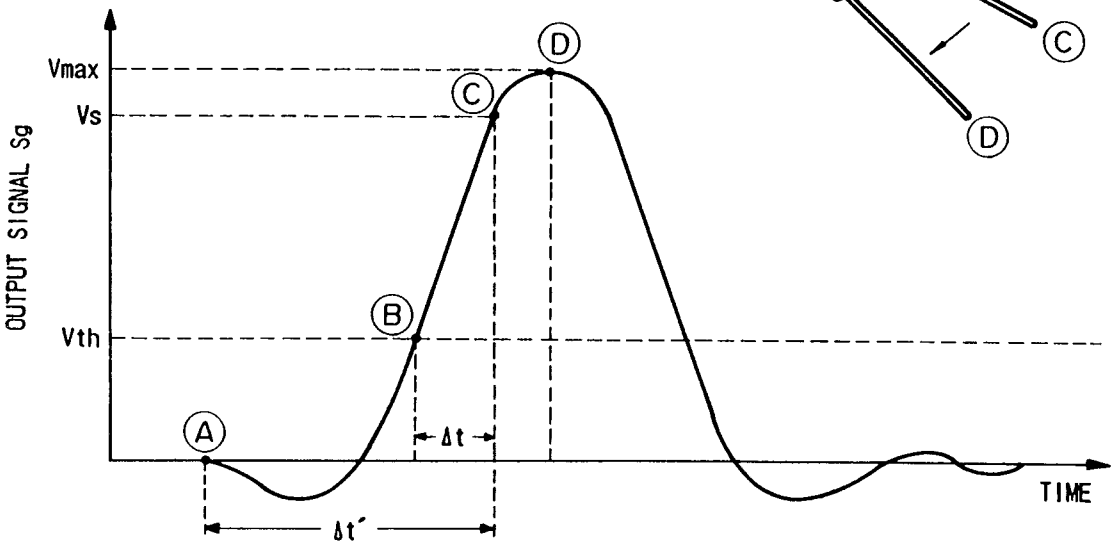
FIG. 4 (VARIATION OF OUTPUT SIGNAL Sg DURING SWING DOWN)

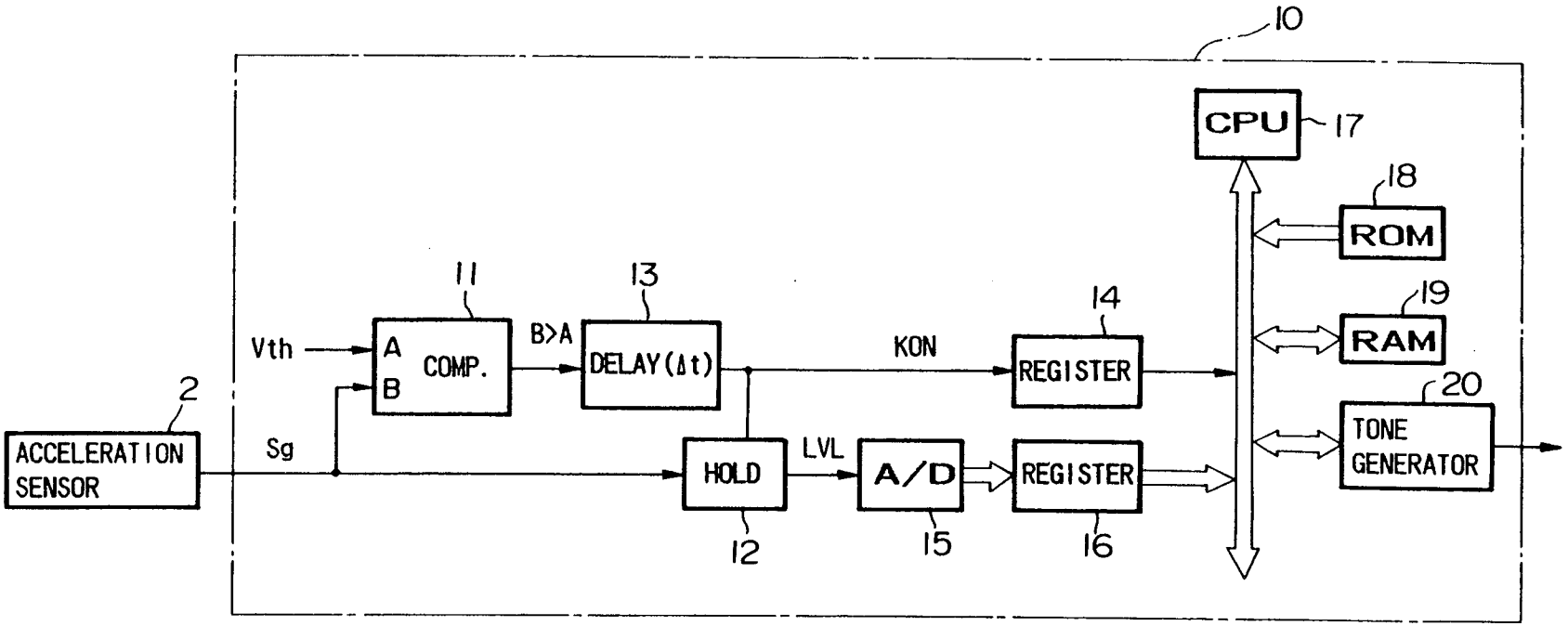
FIG. 5 (FIRST EMBODIMENT)

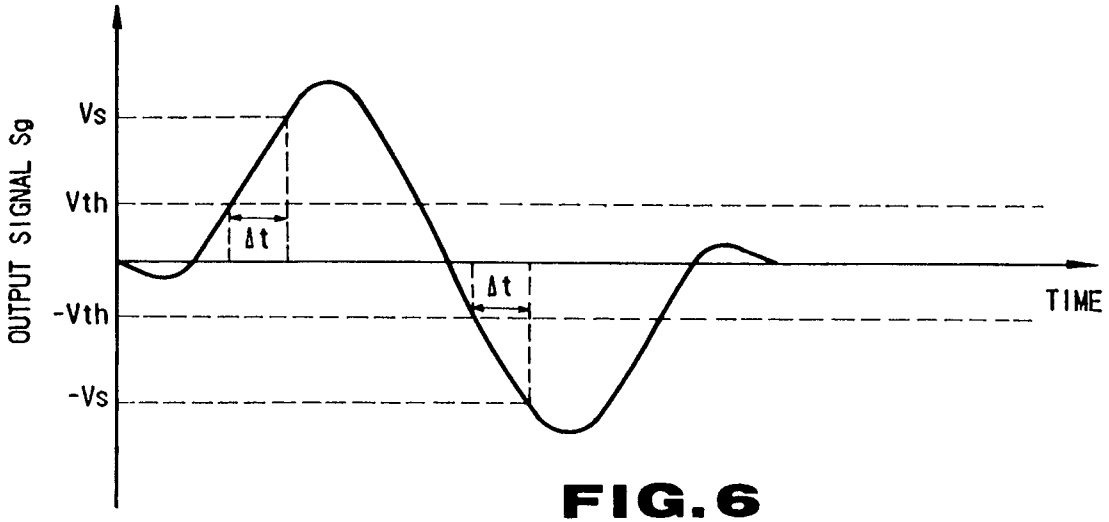
FIG. 6
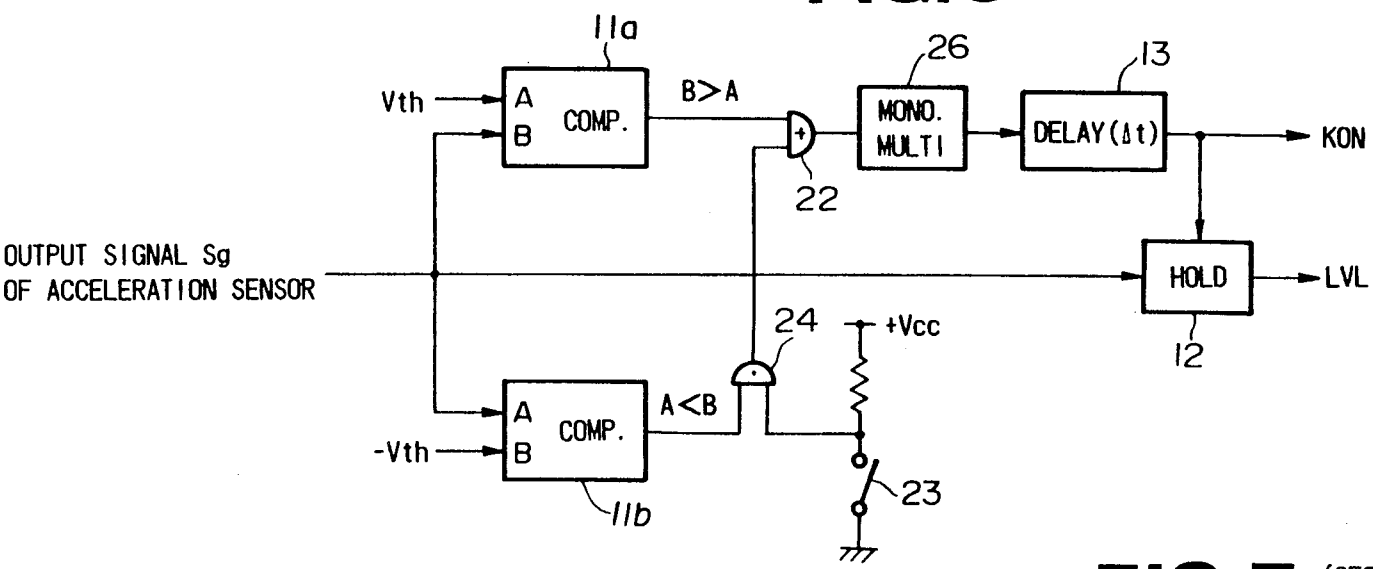
FIG. 7 (SECOND EMBODIMENT)

SWING ACTIVATED MUSICAL TONE CONTROL APPARATUS

BACKGROUND OF THE INVENTION

1. Field of the Invention

The present invention relates to a musical-tone-control apparatus that can control musical tones according to a performer's swing of a baton.

2. Prior Art

As is well known, conventional electronic keyboard instruments are designed to generate musical tones of desired tone pitches and tone colors by the operation of a keyboard or by the operation of various controllers with the hands or the feet. Operations for generating musical tones by the conventional instruments are thus limited to those controlled by the hands and the feet. Hence, the applicant has proposed a new musical-tone-control apparatus that can control musical tones by swinging a baton shown in FIG. 1A and 1B.

In FIG. 1A, numeral 1 designates a baton. It has grip 1*a* to be held in the hand of a performer, and rod 1*b* jointed to grip 1*a*. Rod 1*b* contains acceleration sensor 2 shown in FIG. 1B. Acceleration sensor 2 comprises support members 3 and 3, cantilever spring 4 fixed to support members 3 and 3 on one end, mass 5 of a predetermined weight mounted to the other end of cantilever spring 4, and strain gage 6 including piezoresistive strain-sensing elements such as piezoelectric plastic film for detecting deflection of cantilever spring 4. When a downward or an upward acceleration is given, cantilever spring 4, which is being deflected in the upward or downward direction as shown by the arrow, causes a signal proportional to the acceleration to develop from strain gage 6. Consequently, when a performer holds grip 1*a* with mark 1*c* upwards provided thereto, and swings baton 1 downwards or upwards, acceleration sensor 2 produces output signal Sg proportional to the intensity of the swing.

Output signal Sg is supplied to musical-tone-signal-generating circuit 6 shown in FIG. 2. Musical-tone-signal-generating circuit 6 generates a musical-tone signal of a tone pitch and/or tone volume corresponding to a peak of output signal Sg, and this signal drives speaker SP. Thus, the performer can control musical-tone signals by varying the intensity of swings. For example, the stronger baton 1 is swung, the higher the tone pitches become. The musical-tone-control apparatus described above is designed so that a musical tone is generated at the peak of output signal Sg of acceleration sensor 2 by judging the peak as an intensity of swing of baton 1. However, the apparatus has a disadvantage that the performer feels out of synchronism with the apparatus when he performs, because the generation of a musical tone is delayed a moment after he has completed a swing.

More specifically, when the performer swings baton 1 down from point A in FIG. 3, he feels that he has completed the swing at point C. In reality, however, baton 1 does not stop at point C, and reaches point D because of inertia. According to the movement of baton 1 from point A to D, the amplitude of output signal Sg of acceleration sensor 2 varies as shown in FIG. 4, having a peak value at the lowest point D. Consequently, if a musical tone is generated when the peak value Vmax is developed at point D, the generation of the musical tone is momentarily delayed, and the performer will note a considerable discrepancy between the time of swing completion and the generation of the musical tone.

SUMMARY OF THE INVENTION

It is therefore an object of the invention to provide a musical-tone-control apparatus that can generate a musical tone proportional to the intensity of a swing at the precise moment when a performer feels he has completed the swing.

According to one aspect of the present invention, there is provided a musical-tone-control apparatus comprising:

swing means to be swung by hand;

acceleration-measuring means provided in the swing means for measuring acceleration developed by a swing;

start-point-detecting means for detecting the start point of a swing of the swing means;

timing-signal-generating means for producing generation-timing signal after a predetermined interval has elapsed from the start point;

holding means for maintaining an output signal of the acceleration-measuring means when the generation-timing signal occurs; and musical-tone-control-signal-generating means for generating a musical-tone-control signal to control musical tones according to the content of the holding means.

BRIEF DESCRIPTION OF THE DRAWINGS

FIG. 3 is a schematic view illustrating a swing of baton 1;

FIG. 4 is a timing chart showing a waveform of output signal Sg of acceleration sensor 2 associated with the swing of baton 1;

FIG. 5 is a block diagram showing the electrical configuration of a musical-tone-control apparatus according to a first embodiment of the present invention;

FIG. 6 is a timing chart showing a waveform of output signal Sg of acceleration sensor 2 in accompaniment with the downward and upward swing of baton 1;

FIG. 7 is a block diagram showing the electrical configuration of a musical-tone-control apparatus according to a second embodiment of the invention.

DESCRIPTION OF THE PREFERRED EMBODIMENTS

Figure 1A:
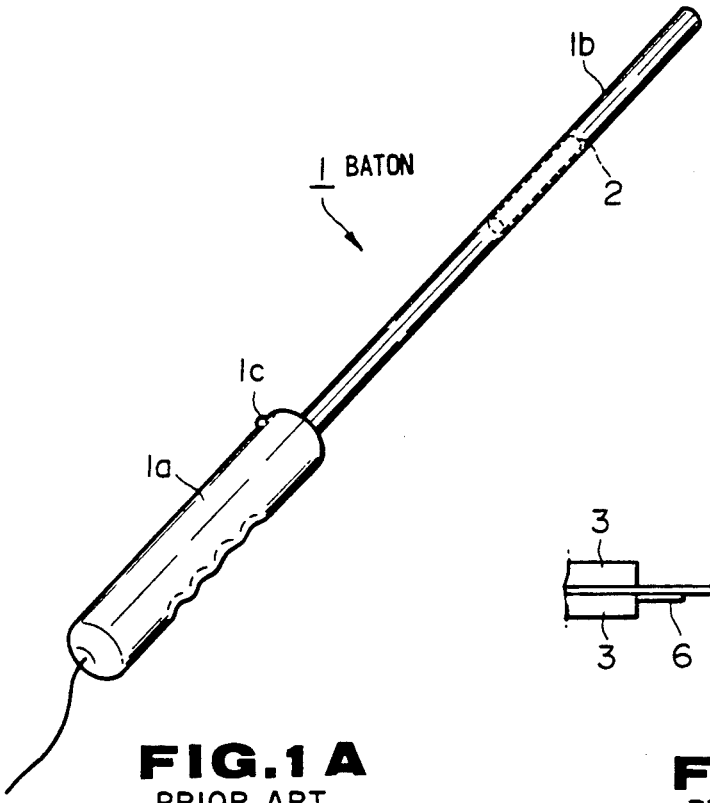
FIG.1A PRIOR ART
FIG. 1A is a perspective view of baton 1.
Figure 1B:
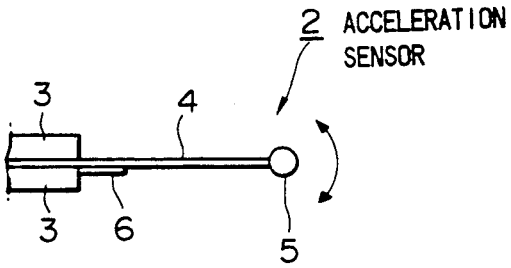
FIG.1B PRIOR ART
FIG. 1B is a front view showing the configuration of acceleration sensor 2 provided in baton 1.
Figure 2:
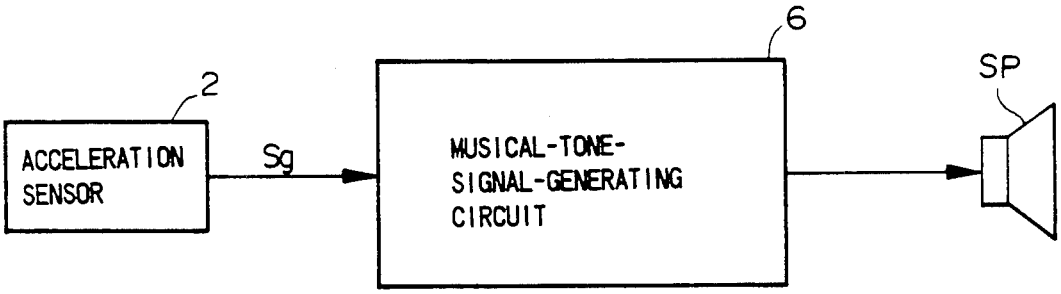
FIG.2 PRIOR ART
FIG. 2 is a block diagram showing an electrical configuration of a conventional musical-tone-control apparatus.

The invention will now be described with reference to the accompanying drawings.

[A] FIRST EMBODIMENT

FIG. 5 is a block diagram showing the electrical configuration of a musical-tone-control apparatus according to a first embodiment of the present invention. In FIG. 5, output signal Sg of acceleration sensor 2 is supplied to comparator circuit 11 and hold circuit 12 in musical-tone-signal-generating circuit 10. Comparator circuit 11 compares output signal Sg with a predetermined threshold Vth, and produces a "High" level signal when Sg>Vth. The output signal of comparator circuit 11 is delayed by delay circuit 13 for a predetermined interval Δt (about 10 ms). The output of the delay circuit 13 is applied to hold circuit 12 and register 14 as key-on signal KON, which corresponds to a signal produced when a key of a keyboard instrument is depressed. Hold circuit 12 loads output signal Sg of acceleration sensor 2 when key-on signal KON is supplied, and produces level signal LV that corresponds to the intensity of the loaded signal. Level signal LVL is converted to digital signals by A/D (analog-to-digital) converter 15, and the digital signals are then sent to register 16. Data in registers 14 and 16 are read sequentially by CPU (central processing unit) 17, and registers 14 and 16 are cleared immediately after the data are read. The read data are then supplied to tone generator 20 in which musical-tone signals are generated according to data associated with key-on signal KON and level signal LVL. Thus, the generation of the timing and the tone pitches of musical-tone signals are controlled. These controls are performed by the programs stored in ROM (Read-Only Memory) 18, using RAM (Random-Access Memory) 19 as a working area.

Next, the operation of the first embodiment will be described.

First, a performer holds baton 1 with mark 1*c* on grip 1*a* upwards, and swings baton 1 down from point A to D as shown in FIG. 3. The acceleration of the swinging motion is detected by acceleration sensor 2, and output signal Sg thereof varies as shown in FIG. 4. When the amplitude of output signal Sg exceeds threshold Vth at point B in FIG. 4, comparator circuit 11 produces a "High" level signal and applies it to delay circuit 13. Delay circuit 13 delays the signal by a constant interval Δt, and produces key-on signal KON, which is supplied to hold circuit 12 and register 14 at point C. Hold circuit 12 holds output signal Sg of value Vs from acceleration sensor 2 by using key-on signal KON, and applies the signal of Vs to A/D converter 15 as level signal LVL that corresponds to the intensity of the swing. Level signal LVL is converted to digital signals and applied to resister 16. Tone generator 20 generates a musical-tone signal of a pitch corresponding to level signal LVL of value Vs that is specified at point C when key-on signal KON is produced.

In the embodiment, as described above, the timing of predetermined interval Δt begins when output signal Sg of acceleration sensor 2 exceeds threshold Vth at point B, and loads signal Sg at point C when interval Δt has elapsed after point B. This is performed on the premise that the interval from point A when the swinging of baton 1 begins to point D when the swinging terminates, is approximately constant regardless of the intensity of swings of baton 1. Output signal Sg is loaded at point C, and is maintained by hold circuit 12, and is then sent to tone generator 20 via A/D converter 15, register 16 and CPU 17, thus controlling the tone pitch generated by tone generator 20 according to the intensity of the swing. Therefore, the timing generation and tone pitches of musical tones are determined by point C, which makes the performer feel that musical tones are generated in synchronism with the termination of swings of baton 1.

[B] SECOND EMBODIMENT

Output signal SG of acceleration sensor 2 varies in the positive direction when baton 1 is swung downward, and varies in the negative direction when it is swung upward as shown in FIG. 6. Consequently, the first embodiment can detect only down swing motions, and hence, a second embodiment is proposed that can detect swings in both directions.

FIG. 7 is a block diagram of the second embodiment. In FIG. 7, comparator circuit 11*l* compares output signal Sg from acceleration sensor 2 with positive threshold Vth, and provides a "High" level signal when Sg>Vth. Similarly, comparator circuit 11*b* compares output signal Sg with negative threshold −Vth, and produces a "High" level signal when Sq<−Vth. The output signal of comparator circuit 11*a* is applied to one input of OR gate 22, and the output signal of comparator circuit 11*b* is applied to the other input of OR gate 22, by way of AND gate 24 that switches the signal according to the operation of mode-transfer switch 23. The output of OR gate 22 is applied to monostable multivibrator 26 that produces a constant width pulse signal. The pulse signal is delayed a predetermined interval Δt by delay circuit 13, and produced as key-on signal KON.

When mode-transfer switch 23 is turned on, AND gate 24 is closed and so the output of comparator circuit 11*b* is not supplied to monostable multivibrator 26. In this case, the second embodiment detects only downswing motions just as in the first embodiment, and functions in a unidirectional mode. In contrast, when mode-transfer switch 23 is turned off, AND gate 24 is opened and the output of comparator circuit 11*b* is supplied to monostable multivibrator 26. Hence, the second embodiment functions in a bidirectional mode that detects both the upward and downward swing of baton 1.

Although specific embodiments of a musical tone control apparatus constructed in accordance with the present invention have been disclosed, it is not intended that the invention be restricted to either the specific configurations or the uses disclosed herein. Modifications may be made in a manner obvious to those skilled in the art as follows:

(a) Though the first embodiment is designed so that level signal LVL controls tone pitches, it can be designed so that the level signal controls other elements of musical tones, such as tone volumes, or tone colors.

(b) The first embodiment is designed to detect point B when output signal Sg of acceleration sensor 2 exceeds threshold Vth, and to start timing from point B in order to load output signal Sg at point C after a predetermined interval has elapsed from point B. However, the timing may be started from points other than point B. For example, point A' (see FIG. 4) at which an actual swing starts may be used as a start point by detecting it by some means, and output signal Sg is maintained at point C after a predetermined interval Δt' has elapsed from point A as shown in FIG. 4.

Accordingly, it is intended that the invention be limited only by the scope of the appended claims.

What is claimed is:

1. A musical-tone-control apparatus comprising:

a swing member adapted to be swung by a performer's hand;

acceleration-measuring means, provided in said swing member, for measuring acceleration produced by a swing;

start-point-detecting means for detecting the start point of a swing of said swing member;

timing-signal-generating means for producing a generation-timing signal after a predetermined interval has elapsed from said start point;

holding means for maintaining an output signal of said acceleration-measuring means when said generation-timing signal occurs; and musical-tone-control-signal-generating means for generating a musical-tone-control signal to control musical tones according to the content of said holding means.

2. A musical-tone-control apparatus according to claim 1, wherein said start-point-detecting means detects said start point when the output of said acceleration-measuring means exceeds a predetermined threshold.

3. A musical-tone-control apparatus according to claim 2, wherein said start-point-detecting means includes a comparing means that compares said output of said acceleration-measuring means with said predetermined threshold and produces a start-point-detecting signal when the output of said acceleration measuring means exceeds said predetermined threshold.

4. A musical-tone-control apparatus according to claim 3, wherein said timing-signal-generating means includes delay means for delaying said start-point-detecting signal by a predetermined interval and producing said generation-timing signal.

5. A musical-tone-control apparatus according to claim 2, wherein said start-point-detecting means includes first comparing means, for comparing said output of said acceleration-measuring means with a predetermined positive threshold, and second comparing means for comparing said output of said acceleration-measuring means with a predetermined negative threshold, and said start-point-detecting means includes a monostable multivibrator that produces a start-point-detecting signal when the output of said acceleration-measuring means exceeds said positive or negative predetermined threshold.

6. A musical-tone-control apparatus according to claim 5, wherein said timing-signal-generating means includes delay means for delaying said start-point-detecting signal for a predetermined interval and producing said generation-timing signal.

7. A musical-tone-control apparatus according to claim 1, wherein said start-point-detecting means detects said start point when a swing of said swing member begins.

8. A musical-tone-control apparatus according to claim 1, wherein said musical-tone-control-signal-generating means controls tone pitches of said musical tones according to the content of said holding means.

9. A musical-tone-control apparatus according to claim 1, wherein said musical-tone-control-signal-generating means controls tone volumes of said musical tones according to the content of said holding means.

10. A musical-tone-control apparatus according to claim 1, wherein said musical-tone-control-signal-generating means controls the tone colors of said musical tones according to the content of said holding means.

* * * * *